US009158282B2

(12) United States Patent
Rochat et al.

(10) Patent No.: US 9,158,282 B2
(45) Date of Patent: Oct. 13, 2015

(54) TIMEPIECE BARREL ASSEMBLY WITH REDUCED CORE DIAMETER

(75) Inventors: Marco Rochat, Le Brassus (CH); Edmond Capt, Le Brassus (CH)

(73) Assignee: BLANCPAIN S.A., Le Brassus (CH)

( * ) Notice: Subject to any disclaimer, the term of this patent is extended or adjusted under 35 U.S.C. 154(b) by 0 days.

(21) Appl. No.: 14/241,714

(22) PCT Filed: Sep. 13, 2012

(86) PCT No.: PCT/EP2012/067902
§ 371 (c)(1),
(2), (4) Date: Feb. 27, 2014

(87) PCT Pub. No.: WO2013/037864
PCT Pub. Date: Mar. 21, 2013

(65) Prior Publication Data
US 2014/0204719 A1 Jul. 24, 2014

(30) Foreign Application Priority Data
Sep. 15, 2011 (EP) ..... 11181353

(51) Int. Cl.
*G04B 1/16* (2006.01)
*G04B 1/14* (2006.01)

(52) U.S. Cl.
CPC ..... *G04B 1/165* (2013.01); *G04B 1/145* (2013.01); *G04B 1/16* (2013.01)

(58) Field of Classification Search
CPC ..... G04B 1/10; G04B 1/14; G04B 1/16; G04B 1/18; G04B 33/14; G04B 35/00; G04B 1/145; G04B 1/165
See application file for complete search history.

(56) References Cited

U.S. PATENT DOCUMENTS

| | | | | |
|---|---|---|---|---|
| 182,629 | A | 9/1876 | Barclay | |
| 1,033,020 | A * | 7/1912 | Kern | 368/142 |
| 1,110,061 | A | 9/1914 | Kienzle | |
| 3,121,990 | A * | 2/1964 | Laviolette | 368/127 |
| 4,077,201 | A * | 3/1978 | Perrot | 368/324 |
| 2005/0249045 | A1 * | 11/2005 | Schneider | 368/140 |
| 2010/0149928 | A1 * | 6/2010 | Reynard | 368/206 |
| 2013/0044574 | A1 * | 2/2013 | Kaelin et al. | 368/318 |
| 2013/0133788 | A1 * | 5/2013 | Aljerf et al. | 148/548 |
| 2013/0223194 | A1 * | 8/2013 | Cattin et al. | 368/143 |

FOREIGN PATENT DOCUMENTS

| | | | |
|---|---|---|---|
| CH | 295 135 | A | 12/1953 |
| CH | 306 103 | A | 3/1955 |
| CH | 324 249 | A | 9/1957 |
| DE | 18 72 388 | U | 5/1963 |
| FR | 1 473 744 | A | 3/1967 |
| GB | 647819 | * | 5/1946 |

* cited by examiner

*Primary Examiner* — Amy Cohen Johnson
*Assistant Examiner* — Matthew Powell
(74) *Attorney, Agent, or Firm* — Sughrue Mion, PLLC

(57) ABSTRACT

Timepiece barrel assembly including a barrel arbor including between first and second guide shoulders, a median shoulder carrying a core and a spring mounted between a drum and this core, this barrel arbor including, between this first shoulder and this core a ratchet-holder for securing a ratchet, and this core including, on the same side as and at a distance from this ratchet-holder, a first part for guiding the pivoting of this drum, in immediate proximity to which there is fixed this ratchet at a distance from and on the same side as this first shoulder, and the ratchet-holder directly or indirectly limits the shake of this drum relative to a bearing surface of this core at the edge of a receiving surface for this spring.

15 Claims, 4 Drawing Sheets

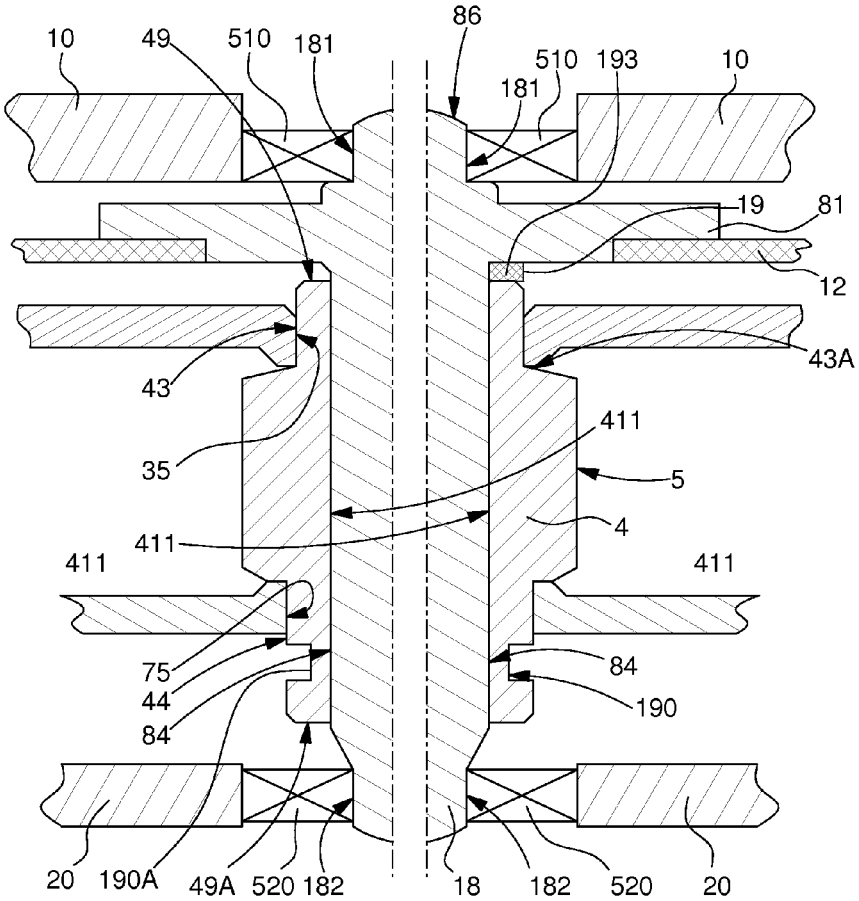
Fig. 5 Fig. 6
Fig. 7
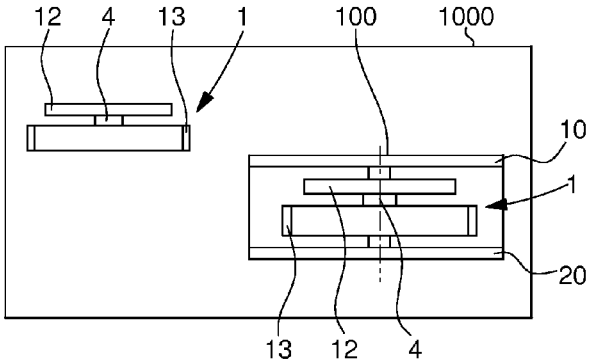

TIMEPIECE BARREL ASSEMBLY WITH REDUCED CORE DIAMETER

CROSS REFERENCE TO RELATED APPLICATIONS

This application is a National Stage of International Application No. PCT/EP2012/067902 filed Sep. 13, 2012, claiming priority based on European Patent Application No. 11181353.1 filed Sep. 15, 2011, the contents of all of which are incorporated herein by reference in their entirety.

FIELD OF THE INVENTION

The invention concerns a timepiece barrel assembly including a barrel arbour pivoting about a pivot axis and extending between, on the one hand, at a first end, a first shoulder for guiding the pivoting of the barrel arbour in a bridge, and on the other hand, at a second end, a second shoulder for guiding the pivoting thereof in a plate, said barrel arbour including, between said first shoulder and said second shoulder, a median shoulder onto which a core is driven, said barrel assembly including at least one barrel mainspring mounted between, at a first outer end, a barrel drum pivoting about said pivot axis, and at a second inner end, a receiving surface of said core.

The invention also concerns a timepiece movement including at least one plate, one bridge and one barrel assembly of this type.

The invention also concerns a timepiece including at least one movement of this type, and/or at least one barrel assembly of this type.

The invention concerns the field of horology, and more specifically the field of energy storage barrels, for powering a movement, a striking work, or another timepiece function.

BACKGROUND OF THE INVENTION

In order to increase the power reserve, by increasing the number of turns of a mainspring, one solution consists in decreasing the diameter of the barrel arbour and of the associated core, so as to increase the space available for the spring inside the drum.

The ratio of the core radius to the spring thickness is usually comprised between 10 and 20 and the invention proposes to reduce this ratio to below 10, and preferably to within a range of between 5 and 10.

The sizing must not be too small; there is a risk of breakage if the core diameter is too small.

In the conventional barrel architecture, a ratchet is axially mounted on a barrel arbour or on a core, via a square, with the ratchet usually being secured by an axial screw. The dimension of this screw and that of the square thus define the minimum diameter of a pivot shoulder. A step portion joined to this pivot shoulder limits the endshake of the arbour or of the core relative to a bottom plate or to a bridge carrying a jewel or similar element.

An even larger diameter than that of the step portion is required for a shoulder for guiding the pivoting of the drum on the arbour or on the core, combined with a step portion limiting the endshake of the drum. The dimension chain required to observe minimal sections of material results in substantial dimensions, which are difficult to reduce. In particular, it is not sufficient merely to reduce all of the dimensions, since the cross-sections of material are then insufficient to ensure fatigue resistance.

The precondition for minimising the diameter of the spring-holder core and the diameter of the barrel arbour is limiting any shake as far as possible, on the one hand between the drum and the core, and on the other hand the shake of the core (or the arbour) relative to the bridges. Shake must naturally be adjusted to allow for any expansion or contraction linked to variations in temperature within the range of use of the watch. The barrel architecture must thus allow for compatibility between shakes, with the lowest possible values, while preventing or at least limiting unwanted and energy consuming friction.

The design of a barrel is connected to generally large scale production, and manufacturing costs must be kept at the lowest possible level, with machining operations simplified as much as possible. Naturally, after-sales requirements mean that the barrel must be easy to dismantle, particularly in order to change the spring.

FR Patent No 306103 in the name of Etablissements Parrenin discloses a hollow core, whose length is equal to the thickness of the barrel, in which a longer, removable arbour pivots in a plate and a bridge. The core and the arbour have complementary pivotal drive means, via a square, yet relative axial motion is allowed between the core and arbour, one of the ends of the arbour including a stepped square driving a ratchet. The ratchet is held outside the barrel, beyond the bridge. A drum pivots on a stepped shoulder of the core, and a cover fixed to the drum pivots on another stepped shoulder of the core. The drum shake relative to the core is limited by two stepped portions of these two stepped shoulders in opposite directions. The core shake relative to the arbour is limited, on the ratchet side, by a stepped portion of the arbour cooperating with an end face of the core, while at the other end the other end face of the core bears on the plate. Limiting the shake of the arbour relative to the plate and to the bridge is achieved in one direction, either indirectly, by the core cooperating with the stepped portion of the arbour, or by the ratchet bearing on the bridge, while in the other direction it is necessary to add, beyond the end of the arbour provided with the ratchet drive square, a removable stop member, or an extra bridge, which has the drawback of increasing the necessary thickness inside the movement.

CH Patent No 324249 in the name of COMPAGNIE DES MONTRES LONGINES, FRANCILLON S.A. discloses a ratchet in a single-piece with the barrel arbour between shoulders for guiding the arbour in the plate and the bridge. The barrel arbour includes a pivotal drive means for a core carrying the spring, with a drum and associated cover pivoting on the core and clamping the core with no axial play. The shake of the arbour is limited in one direction by the ratchet bearing on the bridge, and indirectly in the other direction by the core bearing, via a first end surface on an inner surface of the ratchet, with the opposite end surface bearing on the plate. This mechanism has the drawback of requiring a bridge to be removed for any repairs.

DE Patent No 1872388 in the name of EPPLE KG OTERO UHREN discloses a mechanism which is bulky in thickness and wherein shake is limited by a strip-spring cooperating with a groove in the arbour, between the bridge and the drum.

U.S. Pat. No. 1,110,061 in the name of KIENZLE discloses a barrel arbour capped with a core, the arbour including a groove parallel to its axis, in which a longitudinal pin acts as coupling/uncoupling cam between the core and the arbour according to the direction of pivoting of the arbour. The drum pivots on the core, as does the cover fixed to the drum. The length of the core just matches the distance of centres between the plate and the bridge, and the arbour can be fitted into the core after the lateral insertion of the assembly formed by the core, spring, drum and cover. The drum shake is limited by the bridge in one direction and by a stepped portion of the core in the other direction. Here again, limiting the shake of the arbour relative to the plate and to the bridge requires a flange to be added to the bridge to limit the travel of the ratchet, which is detrimental as regards the thickness of the mechanism.

CH Patent No 295135 in the name of BRAC AG discloses a smooth arbour including a head retained by a stepped portion of a centring sleeve of a plate, the other smooth end of the arbour pivoting in a bridge. A drum and a cover grip a core, which is coaxial with the arbour, with axial play and between two shoulders. On the smooth side of the arbour, the core carries a ratchet. The endshake of the core is limited in the direction in which the arbour head is supported in the centring sleeve by the ratchet bearing on a fillet of the bridge, and in the opposite direction by an end face of the core bearing on the centring sleeve. The centring sleeve represents additional thickness for the barrel.

U.S. Pat. No. 182,629 in the name of BARCLAY discloses a safety barrel of more complex execution, including an overload protection mechanism with radially moveable corners pushed by an additional spring.

FR Patent No 1473744 in the name of GHIELMETTI discloses a particular barrel, which includes a cover provided with slots cooperating with lugs of a non-metallic strip inserted between the spring and an auxiliary strip-spring.

These mechanisms either include a core of large diameter leaving little space for the spring, or shake-limiting components which are added to the stack of components required for operation of the barrel, and increase the total thickness of the barrel.

SUMMARY OF THE INVENTION

As a result of these physical limitations on the dimensioning of the various components, it is necessary to envisage different barrel architectures from the conventional architecture that has just been described.

A significant constraint is ensuring that the assembly can be dismantled, if necessary, to change the mainspring.

The invention proposes to set in place a solution allowing the core diameter to be significantly reduced compared to the prior art.

The invention therefore concerns a timepiece barrel assembly including a barrel arbour pivoting about a pivot axis and extending between, on the one hand, at a first end, a first shoulder for guiding the pivoting of the barrel arbour in a bridge, and on the other hand, at a second end, a second shoulder for guiding the pivoting of the barrel arbour in a plate, said barrel arbour including, between said first shoulder and said second shoulder, a median shoulder onto which a core is driven, said barrel assembly including at least one barrel mainspring mounted between, at a first outer end, a barrel drum pivoting about said pivot axis, and at a second inner end, a receiving surface of said core, characterized in that said barrel arbour includes, between said first shoulder and said core, a ratchet-holder integral with said barrel arbour and including a shoulder for driving in or fixing a ratchet, in that said core includes, on the side of said ratchet-holder and at a distance therefrom, a first outer shafted top part on which said drum is pivotally guided by a bore of said drum, and further characterized in that said ratchet is fixed at a distance from and in immediate proximity to said first outer shafted part on the same side as said shafted part relative to said first shoulder, and in that said ratchet-holder directly or indirectly limits the shake of said drum relative to a bearing surface comprised in said core at the edge of said spring receiving surface.

According to a feature of the invention, said first shoulder is limited on said ratchet-holder side by a stepped end portion of said barrel arbour, and said barrel arbour and said core confine, with functional play, a bearing ring which can be moved on said shoulder between, on the one hand and on a first side of said ring, either a first stepped portion of said barrel arbour or said ratchet-holder, and on the other hand and on a second side of said bearing ring opposite to said first side, a first end face of said core, on the opposite side to a second end face of said core, said second end face defining, with said stepped end portion of said barrel arbour, a functional distance of centres of said barrel assembly between the bearings of a bridge and of a plate in which said barrel assembly rotates on pivots on said first shoulder and said second shoulder.

According to a feature of the invention, said barrel assembly includes a means of extraction arranged to allow the axial extraction of said core, along said pivot axis, by the exertion of a thrust or traction force on said core.

According to a feature of the invention, said core is made in two parts, a first tubular portion arranged to cooperate with said barrel arbour and including, at its two opposite axial ends, said first end face and said second end face, and the external diameter of said tubular portion forms a first outer shafted portion arranged to form a pivot for a bore of said drum, and the other second substantially tubular portion includes a bore driven onto said first outer shafted portion and said second portion either includes said mainspring receiving surface, or forms the inner end of said mainspring.

According to a feature of the invention, said barrel and said core together form a welded single-piece spring-core subassembly.

The invention also concerns a timepiece movement including at least a plate, a bridge, and a barrel assembly of this type, pivoting via said first shoulder and said second shoulder thereof respectively in said bridge and said plate, for storing energy, with one input formed either by said ratchet, mounted for integral rotation with said ratchet-holder, or by a drum toothing mounted for integral rotation with said drum, and an output respectively formed either by a drum toothing mounted for integral rotation with said drum, or by said ratchet mounted for integral rotation with said ratchet-holder.

The invention also concerns a timepiece including at least one timepiece movement of this type and/or at least one barrel assembly of this type, for storing energy, with one input formed either by said ratchet, mounted for integral rotation with said ratchet-holder, or by a drum toothing mounted for integral rotation with said drum, and an output respectively formed either by a drum toothing mounted for integral rotation with said drum, or by said ratchet mounted for integral rotation with said ratchet-holder.

BRIEF DESCRIPTION OF THE DRAWINGS

Other features and advantages of the invention will appear more clearly upon reading the following detailed description, with reference to the annexed drawings, in which:

FIG. 5 shows, in a similar manner to FIG. 2, another barrel variant according to the invention, with a ratchet-holder located underneath the bridge, and a means of extracting the core; and FIG. 6 is a variant of the same barrel with the insertion of a shim-washer between the core and the barrel arbour.

FIG. 7 shows block diagrams of a timepiece movement including a barrel assembly according to the invention and a timepiece including the movement and a barrel assembly according to the invention.

DETAILED DESCRIPTION OF PREFERRED EMBODIMENTS

Figure 1:
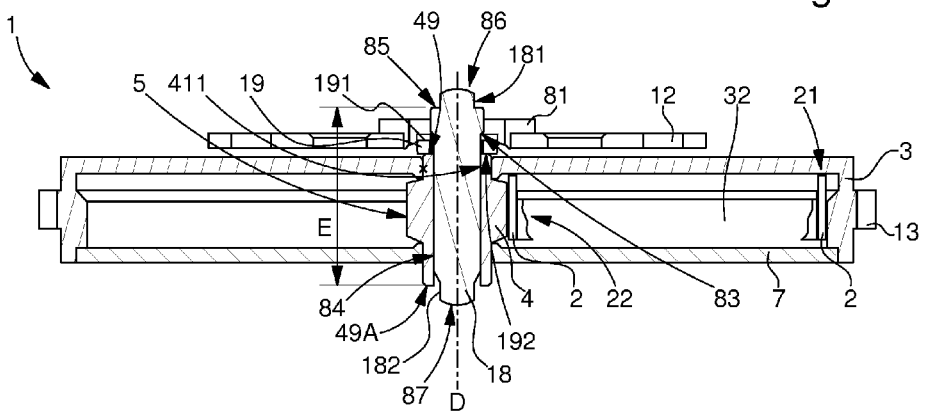
FIG. 1 shows a schematic cross-section of a timepiece barrel according to the invention with a core mounted on a barrel arbour, in a plane passing through the pivot axis of the barrel.

The invention concerns the field of horology, and more specifically the field of energy storage barrels, for powering a movement, a striking work, or another timepiece function.

More specifically, the invention concerns a barrel for a mechanical watch having a reduced core diameter.

The invention concerns a timepiece barrel assembly 1 including a barrel arbour 18 pivoting about a pivot axis D and extending between, on the one hand, at a first end 86, a first shoulder 181 for guiding the pivoting of the barrel arbour in a bridge 10, particularly in a jewel 510 driven into bridge 10, and on the other hand, at a second end 87, a second shoulder 182 for guiding the pivoting of the barrel arbour in a plate 20, in particular in a jewel 520 driven into said plate 20.

Barrel arbour 18 includes, between first shoulder 181 and second shoulder 182, a median shoulder 84 onto which a core 4 is driven.

This barrel assembly 4 includes at least one barrel mainspring 2, which is mounted between, at a first outer end 21, a barrel drum 3 pivoting about pivot axis D, and at a second inner end 22, a receiving surface of core 4.

According to the invention, barrel arbour 18 includes, between first shoulder 181 and core 4, a ratchet-holder 81 integral with barrel arbour 18 and including a shoulder for driving in or securing a ratchet 2.

Depending upon the embodiment, barrel arbour 18 and ratchet-holder 81 are either a single-piece assembly produced for example directly by turning, or two independent components securely fixed one on top of the other, for example one driven onto the other. The advantage of an embodiment having a ratchet-holder 81 driven onto arbour 18 is that it can be dismantled, even if a significant tightening force is used to drive on the ratchet-holder.

Fitting a ratchet-holder 81 removes a conventional obstacle to the use of a barrel arbour of small diameter, said obstacle generally being the presence of a ratchet drive square at the end of the arbour. The ratchet has corresponding female machining and both the male square and the female square must have a certain minimum dimension in order to be machinable at a reasonable cost on the one hand and to be sufficiently resistant to absorb the maximum torque and any shocks on the other hand. Using ratchet-holder 81 means that this square is no longer necessary and the drive means can be replaced by other means which are easier and less expensive to produce, such as flat drive portions, or several screws arranged in a star shape over the flange of ratchet-holder 81.

Further, core 4 includes, on the side of ratchet-holder 81 and at a distance therefrom, a first, top, outer, shafted portion 43, on which the pivoting of drum 3 is guided by a bore 35 of drum 3.

Further, ratchet 12 is fixed at a distance from and in immediate proximity to the first outer shafted portion 43 and on the same side as said portion 43 relative to first shoulder 181. Ratchet-holder 81 directly or indirectly limits the shake of drum 3 relative to a bearing surface 43A comprised in core 4 at the edge of receiving surface 5 for spring 2.

The configuration according to the invention makes it possible to limit the value of the maximum radius of core 4 relative to pivot axis D, and in particular, with an ordinary mainspring, to a value of less than ten times the maximum thickness of spring 2.

In the version illustrated in FIG. 1, barrel arbour 18 extends between a first end 86 including a stepped end portion 85 and a second end 87 including a shoulder 84 onto which a bore 411 of core 4 is forcibly driven along pivot axis D.

The first shoulder 181 of arbour 18 is limited on the side of ratchet-carrier 81 by a stepped end portion 85 of said barrel arbour 18.

Preferably, in order to limit energy loss by friction, the maximum diameter of end stepped portion 85 is less than that of a jewel 510 in which the first end shoulder 181 of arbour 18 pivots.

Likewise, core 4 includes, in proximity to the second end shoulder 182 of arbour 18, which pivots in a jewel 520, an end surface 49A, and the maximum diameter of this end surface 49A is less than that of jewel 520.

Preferably, as seen in the Figures, the first shoulder 181 has a smaller diameter than the diametral dimension of arbour 18 at ratchet-holder 81, or depending on the case, of a shoulder 88 onto which ratchet-holder 81 is fitted.

Preferably, first shoulder 181 of plate 2 has a smaller diameter than that of median shoulder 84 of core 4.

In an advantageous embodiment visible in FIGS. 1, 2, 3, 4 and 6, barrel arbour 18 and core 4 confine a bearing ring 19 with functional play J. Ring 19 is moveable on shoulder 84, between:

- on the one hand and on a first side 191 of ring 19, either a first stepped portion 83 of barrel arbour 18, or ratchet-holder 81,
- and on the other hand and on a second side 192 of bearing ring 19 opposite to first side 191, a first end face 49 of core 4.

Core 4 has a second end face 49A, on the opposite side to first end face 49.

This second end face 49A defines, with stepped end portion 85 of barrel arbour 18, a functional distance of centres E of barrel assembly 1 between the bearings of a bridge 10 and of a plate 20 in which the barrel arbour rotates on pivots respectively on first shoulder 181 and of second shoulder 182.

Preferably, functional play J is comprised between 0.04 mm and 0.08 mm.

In a variant, ratchet-holder 81 has an inner housing for receiving said bearing ring 19.

In a preferred embodiment facilitating disassembly, barrel assembly 1 of the invention includes a means of extraction 190 arranged to allow the axial extraction of core 4, along pivot axis D, by the exertion of a thrust or traction force on core 4.

This extraction means is formed by at least one groove 190A and/or a stepped portion comprised in core 4 in proximity to second end face 49A of core 4. This second end face 49A is located, at one of the ends thereof opposite bearing face 43A and beyond a second bottom outer shafted portion 44 of core 4.

As illustrated, spring 2 is preferably confined within a chamber 32 delimited by drum 3 and a cover 7 fixed to drum 3.

This second part 44 is then arranged for slideably receiving a bore 75 of a cover 7 arranged to form, with drum 3, said chamber 32 containing the at least one mainspring 2.

Preferably, to take advantage of the advantageous configuration of the invention, in the variant where ratchet-holder 81 is driven onto a shoulder 88 of barrel arbour 18, as seen in FIG. 1, the diameter of shoulder 88 is smaller, on the one hand than the diameter of bore 35 of drum 3, and on the other hand than diameter 75 of the bore of cover 7.

Figure 2:
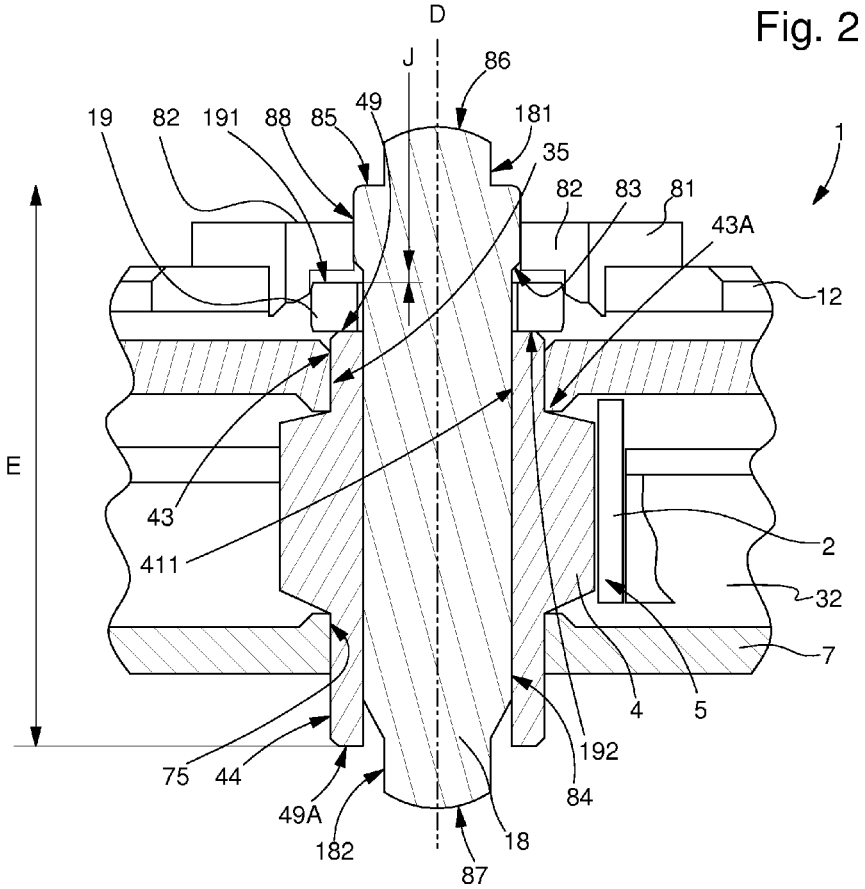
FIG. 2 is a detail of the central portion of FIG. 1.
Figure 3:
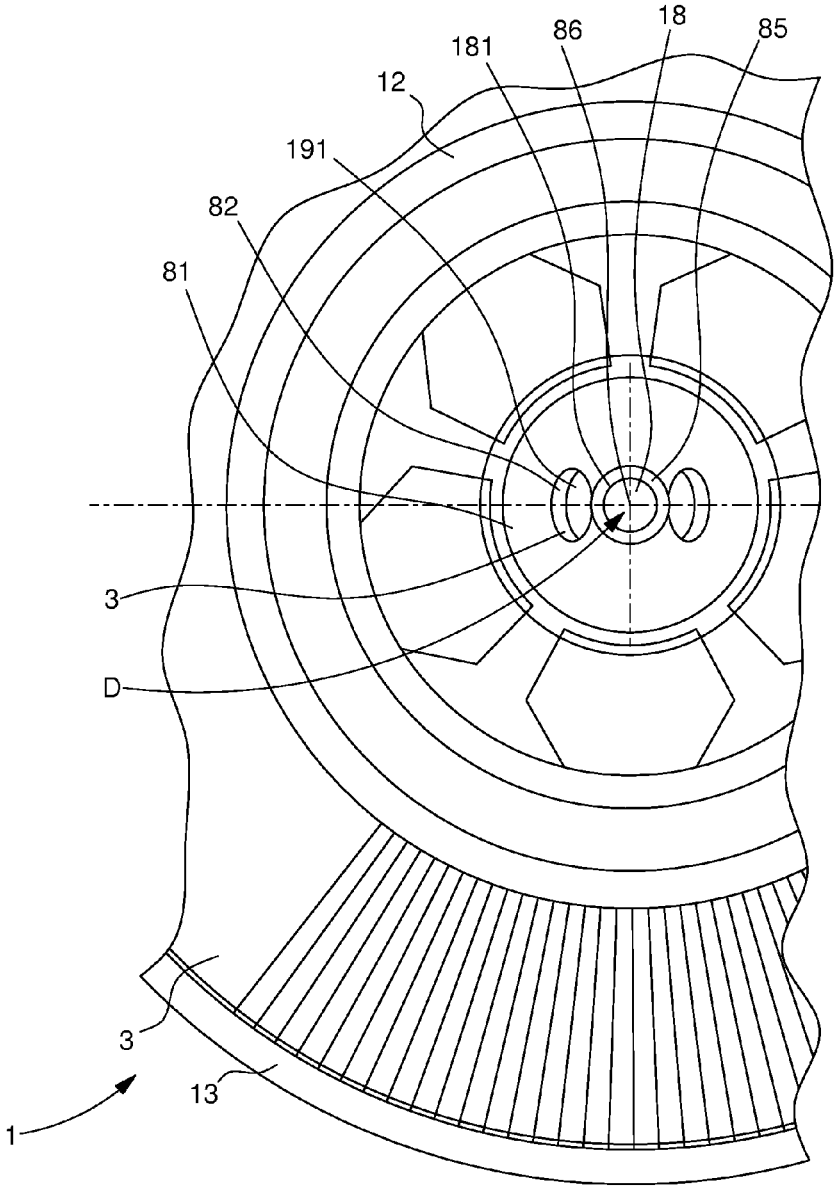
FIG. 3 is a partial top view of the barrel assembly of FIG. 1.

In an advantageous variant illustrated in FIGS. 1 to 3, ratchet-holder 81 includes at least one notch 82 in immediate proximity to first stepped portion 83 and partially superposed on bearing ring 19 to allow a thrust force to be exerted on bearing ring 19 to disassemble said ring using a tool inserted through notch 82, said at least one notch and bearing ring 49 thereby together forming means 190 of extracting core 4.

Figure 4:
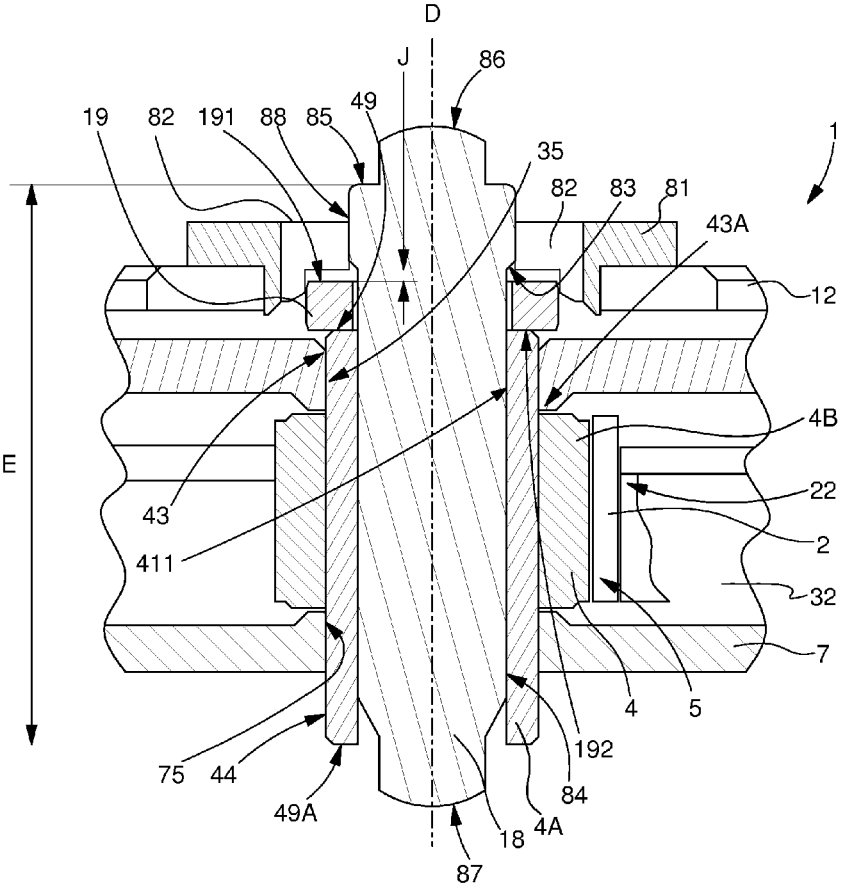
FIG. 4 is a variant of the barrel of FIG. 1, with a core made in two coaxial parts mounted on a barrel arbour.

In the FIG. 4 variant, core 4 is made in two parts, a first tubular portion 4A, also called A in the Figure, arranged to cooperate with barrel arbour 18, and including at both opposite axial ends a first end face 49 and a second end face 49A.

The external diameter of tubular portion 4A forms a first, outer, shafted part 43 arranged to form a pivot of a bore 35 of drum 3, and preferably also to guide cover 7, when barrel assembly 1 has such a cover as in the variants illustrated in the Figures. The other second portion 4B, also called B in the Figure, is substantially tubular and includes a bore driven onto the first outer shafted part 43.

This second portion 4B or B, either includes the receiving surface 5 for mainspring 2, or forms the inner end of mainspring 2 in a particularly advantageous welded or similar single-piece embodiment of an assembly formed of spring 2 and of second portion 4B.

FIG. 5 shows, in a similar manner to FIG. 2, another barrel variant according to the invention, with a ratchet-holder 81 located underneath the bridge, and a means 190 of extracting the core formed here by a groove 190A.

FIG. 6 is a variant of the same barrel with the insertion of a shim-washer 193 between the core and the barrel arbour.

In a preferred embodiment, ratchet-holder 81 has a pivotal drive means, for example flat portions, for ratchet 12 which includes a complementary means, for example a groove, said ratchet 12 being confined between ratchet-holder 81 and drum 3. This arrangement further facilitates the simplified manufacture of ratchet 12, made possible by using ratchet-holder 81 of the invention.

In a preferred variant, receiving surface 5 includes a substantially helical bearing surface for spring 2, with generatrices parallel to pivot axis D, with a pitch matching the thickness of spring 2, or matching the radial projecting dimension of a hook for hooking spring 2, comprised in receiving surface 5.

In a variant, receiving surface 5 is a surface of revolution relative to pivot axis D.

In a variant that is not illustrated, spring 2 is fixed by friction to core 4.

Advantageously, spring 2 forms, with core 4, a single-piece, welded or soldered or similar inseparable spring-core sub-assembly.

Preferably, the spring is made of a multiphase, cobalt-nickel-chromium based alloy, comprising 44 to 46% cobalt, 20 to 22% nickel, 17 to 19% chromium, 4 to 6% iron, 3 to 5% tungsten, 3 to 5% molybdenum, 0 to 2% titanium, 0 to 1% beryllium, and having a Young's modulus of between 200 and 240 GPa and a shear modulus of between 80 and 100 GPa, and having a width to thickness ratio of between 3 and 23, more particularly between 9 and 21, and the maximum radius of the steel or stainless steel core relative to the pivot axis is less than nine times the maximum width of the spring.

The invention also concerns a timepiece movement 100 including a plate, a bridge and at least one barrel assembly 1 for storing energy, pivoting via its first shoulder 181 and second shoulder 182 respectively in bridge 10 and plate 20, as seen in FIG. 5 or 6. Assembly 1 has one input formed either by a ratchet 12 mounted for integral rotation with core 81, or by a drum toothing 13 mounted for integral rotation with drum 3, and an output respectively formed either by a drum toothing 13 mounted for integral rotation with drum 3, or by a ratchet 12 mounted for integral rotation with core 81.

The invention also concerns a timepiece 1000 including at least one timepiece movement 100 and/or at least one barrel assembly 1 for storing energy with one input formed either by a ratchet 12 mounted for integral rotation with ratchet-holder 81, or by a drum toothing 13 mounted for integral rotation with drum 3, and an output formed respectively either by a drum toothing 13 mounted for integral rotation with drum 3, or by a ratchet 12 mounted for integral rotation with ratchet-holder 81.

The particular arrangement of the barrel of the invention makes it possible to limit the radial dimension of the core to a low diameter value, without increasing the thickness of the barrel. The useful volume of the chamber delimited by the drum and the cover is therefore optimised. It is possible to dismantle the barrel without removing any bridges

The invention claimed is:

1. A Timepiece barrel assembly including a barrel arbour pivoting about a pivot axis and extending between, on the one hand, at a first end, a first shoulder for guiding the pivoting of the barrel arbour in a bridge, and on the other hand, at a second end, a second shoulder for guiding the pivoting of the barrel arbour in a plate, said barrel arbour including, between said first shoulder and said second shoulder, a median shoulder onto which there is driven a core, said barrel assembly including at least one barrel mainspring mounted between, at a first outer end, a barrel drum pivoting about said pivot axis, and at a second inner end, a receiving surface of said core, wherein said barrel arbour includes, between said first shoulder and said core, a ratchet-holder integral with said barrel arbour and including a shoulder for driving on or fixing a ratchet, wherein said core includes, on the side of said ratchet-holder and at a distance therefrom, a first, top, outer, shafted part on which the pivoting of said drum is guided by a bore of said drum, and further wherein said ratchet is fixed in immediate proximity to said first outer shafted part on the same side as said shafted part relative to said first shoulder but not in contact with said first outer shafted part, and wherein said ratchet-holder directly or indirectly limits the shake of said drum relative to a bearing surface comprised in said core at the edge of said receiving surface for said spring.

2. The Barrel assembly according to claim 1, wherein said first shoulder is limited on said ratchet-holder side by a stepped end portion of said barrel arbour, and said barrel arbour and said core confine, with a functional play, a bearing ring which can be moved on said shoulder between, on the one hand and on a first side of said ring, either a first stepped portion of said barrel arbour or said ratchet-holder, and on the other hand and on a second side of said bearing ring opposite to said first side, a first end face of said core, on the opposite side to a second end face of said core, said second end face defining, with said stepped end portion of said barrel arbour, a functional distance of centres of said barrel assembly between the bearings of a bridge and of a plate in which said barrel assembly rotates on pivots on said first shoulder and said second shoulder.

3. The barrel assembly according to claim 2, wherein said functional play is comprised between 0.04 mm and 0.08 mm.

4. The barrel assembly according to claim 2, wherein said ratchet-holder includes an inner housing for receiving said bearing ring.

5. The barrel assembly according to claim 2, wherein said ratchet-holder includes at least one notch in immediate proximity to said first stepped portion and partially superposed on said bearing ring to allow a thrust force to be exerted on said bearing ring to disassemble said ring using a tool inserted through said notch, said at least one notch and said bearing ring together forming a means of extracting said core.

6. The barrel assembly according to claim 1, wherein the diameter of said first shoulder of said barrel arbour is less than that of said median shoulder of said core.

7. The barrel assembly according to claim 1, wherein said assembly includes a means of extraction arranged to allow the axial extraction of said core, along said pivot axis, by the exertion of a thrust or traction force on said core, said means is formed by at least one groove and/or stepped portion comprised in said core in proximity to a second end face of said core, at one of the ends thereof opposite said bearing face and beyond a second outer, bottom, shafted part of said core and arranged for slideably receiving a bore of a cover arranged to form, with said drum, a chamber containing said at least one mainspring.

8. The barrel assembly according to claim 1, wherein said spring is confined within a chamber delimited by said drum and a cover fixed to said drum, and wherein said core includes a second, outer, bottom, shafted part on which a bore of said cover slides.

9. The barrel assembly according to claim 1, wherein said core is made in two parts, a first tubular portion, arranged to cooperate with said barrel arbour, and including at both opposite axial ends thereof a first end face and a second end face, and wherein the external diameter of said tubular portion forms a first outer shafted part forming a pivot for a bore of said drum, and the other second substantially tubular portion including a bore driven onto said first, outer shafted part and said second portion either includes said receiving surface for said mainspring or forms the inner end of said mainspring.

10. The barrel assembly according to claim 1, wherein said ratchet-holder includes a pivotal drive means for said ratchet confined between said ratchet-carrier and said drum.

11. The barrel assembly according to claim 1, wherein said spring is fixed by friction to said core.

12. The barrel assembly according to claim 1, wherein said spring and said core together form an inseparable welded single-piece spring-core sub-assembly.

13. The barrel assembly according to claim 1, wherein said spring is made of a multiphase, cobalt-nickel-chromium based alloy, comprising 44 to 46% cobalt, 20 to 22% nickel, 17 to 19% chromium, 4 to 6% iron, 3 to 5% tungsten, 3 to 5% molybdenum, 0 to 2% titanium, 0 to 1% beryllium, and having a Young's modulus of between 200 and 240 GPa and a shear modulus of between 80 and 100 GPa and having a width to thickness ratio of between 9 and 21, and wherein the maximum radius of said steel or stainless steel core relative to said pivot axis is less than nine times the maximum width of said spring.

14. The timepiece movement including at least a plate, a bridge, and a barrel assembly according to claim 1, pivoting via said first shoulder and said second shoulder thereof respectively in said bridge and said plate, for storing energy, with one input formed either by said ratchet, mounted for integral rotation with said ratchet-holder, or by a drum toothing mounted for integral rotation with said drum, and an output respectively formed either by a drum toothing mounted for integral rotation with said drum, or by said ratchet mounted for integral rotation with said ratchet-holder.

15. A timepiece including at least one timepiece movement according to claim 14 and at least one barrel assembly for storing energy with one input formed either by said ratchet, mounted for integral rotation with said ratchet-holder, or by a drum toothing mounted for integral rotation with said drum, and an output respectively formed either by a drum toothing mounted for integral rotation with said drum, or by said ratchet mounted for integral rotation with said ratchet-holder, the timepiece barrel assembly including a barrel arbour pivoting about a pivot axis and extending between, on the one hand, at a first end, a first shoulder for guiding the pivoting of the barrel arbour in a bridge , and on the other hand, at a second end, a second shoulder for guiding the pivoting of the barrel arbour in a plate, said barrel arbour including, between said first shoulder and said second shoulder, a median shoulder onto which there is driven a core, said barrel assembly including at least one barrel mainspring mounted between, at a first outer end, a barrel drum pivoting about said pivot axis, and at a second inner end, a receiving surface of said core, wherein said barrel arbour includes, between said first shoulder and said core, a ratchet-holder integral with said barrel arbour and including a shoulder for driving on or fixing a ratchet, wherein said core includes, on the side of said ratchet-holder and at a distance therefrom, a first, top, outer, shafted part on which the pivoting of said drum is guided by a bore of said drum, and further wherein said ratchet is fixed in immediate proximity to said first outer shafted part on the same side as said shafted part relative to said first shoulder but not in contact with said first outer shafted part, and wherein said ratchet-holder directly or indirectly limits the shake of said drum relative to a bearing surface comprised in said core at the edge of said receiving surface for said spring.

* * * * *